United States Patent [19]

Mazzorana

[11] Patent Number: 4,503,338

[45] Date of Patent: Mar. 5, 1985

[54] SYSTEM FOR CONTROLLING THE ADVANCE AND ROTATION OF THE ACTUATOR OF A STARTER FOR HEAT ENGINE

[75] Inventor: Alfred B. Mazzorana, Venissieux, France

[73] Assignee: Societe de Paris et du Rhone, Lyons, France

[21] Appl. No.: 554,485

[22] Filed: Nov. 22, 1983

[30] Foreign Application Priority Data

Nov. 26, 1982 [FR] France ..... 82 20104

[51] Int. Cl.[3] ..... F02N 11/00; F02N 15/06

[52] U.S. Cl. ..... 290/38 R; 123/185 G

[58] Field of Search ..... 123/179 R, 179 K, 185 CA, 123/185 F, 185 G, 185 N; 290/38 R

[56] References Cited

U.S. PATENT DOCUMENTS

| | | | |
|---|---|---|---|
| 1,027,798 | 5/1912 | Beck | 123/185 F |
| 1,055,550 | 3/1913 | Meeder | 123/185 G |
| 1,190,100 | 7/1916 | Brown et al. | 123/185 G |
| 1,455,227 | 5/1923 | Rudolph | 123/185 G |
| 1,990,306 | 2/1935 | Nardone | 123/179 R |
| 3,905,245 | 9/1975 | Mortensen | 123/179 K |

FOREIGN PATENT DOCUMENTS

| | | |
|---|---|---|
| 2443658 | 9/1974 | Fed. Rep. of Germany . |
| 3042436 | 7/1980 | Fed. Rep. of Germany . |
| 56-17658 | 5/1981 | Japan . |

*Primary Examiner*—S. J. Witkowski
*Assistant Examiner*—Shelley Wade
*Attorney, Agent, or Firm*—Dowell & Dowell

[57] ABSTRACT

The invention relates to a system for controlling the advance and rotation of the actuator of a starter for a heat engine. The shaft of the electric motor rotates a dish provided with an inner thread cooperating with a screw bearing a toothed tail. The latter actuates satellites which rotate the bell and the pinion via a free wheel. When the screw reaches the stop, the pinion rotates and actuates the engine. When the latter has started up, the free wheel stalls and the clutch rotates the bell so that the screw returns to its initial position. The invention is more particularly applicable to an electric starter.

13 Claims, 3 Drawing Figures

SYSTEM FOR CONTROLLING THE ADVANCE AND ROTATION OF THE ACTUATOR OF A STARTER FOR HEAT ENGINE

The present invention relates to improvements in starters for heat engines and in particular to a system for controlling the advance of the actuator of a starter incorporating a reduction gear ensuring self-orientation and drive of its pinion so that it meshes with the ring gear of the heat engine and communicates a movement of rotation thereto. In other words, thanks to the invention, the contactor which is generally used for advancing the actuator by means of a tipping lever is eliminated.

Applicant's No. FR-A-78 32871 describes a starter of which the actuator pinion is advanced by taking energy from the armature of the electric motor.

The general arrangement of the starter according to the document mentioned above is complex and its cost price is consequently high. In addition, it is necessary to block the satellite-carrier by means of a tipping lever with passage through a point of unstable equilibrium, with the result that, in certain severe conditions, operation may be poor.

It is an object of the improvements according to the present invention to overcome the above drawbacks and to enable a reliably operating starter for internal combustion engine to be produced simply and economically.

The invention will be more readily understood on reading the following description with reference to the accompanying drawings, in which.

Figure 1:
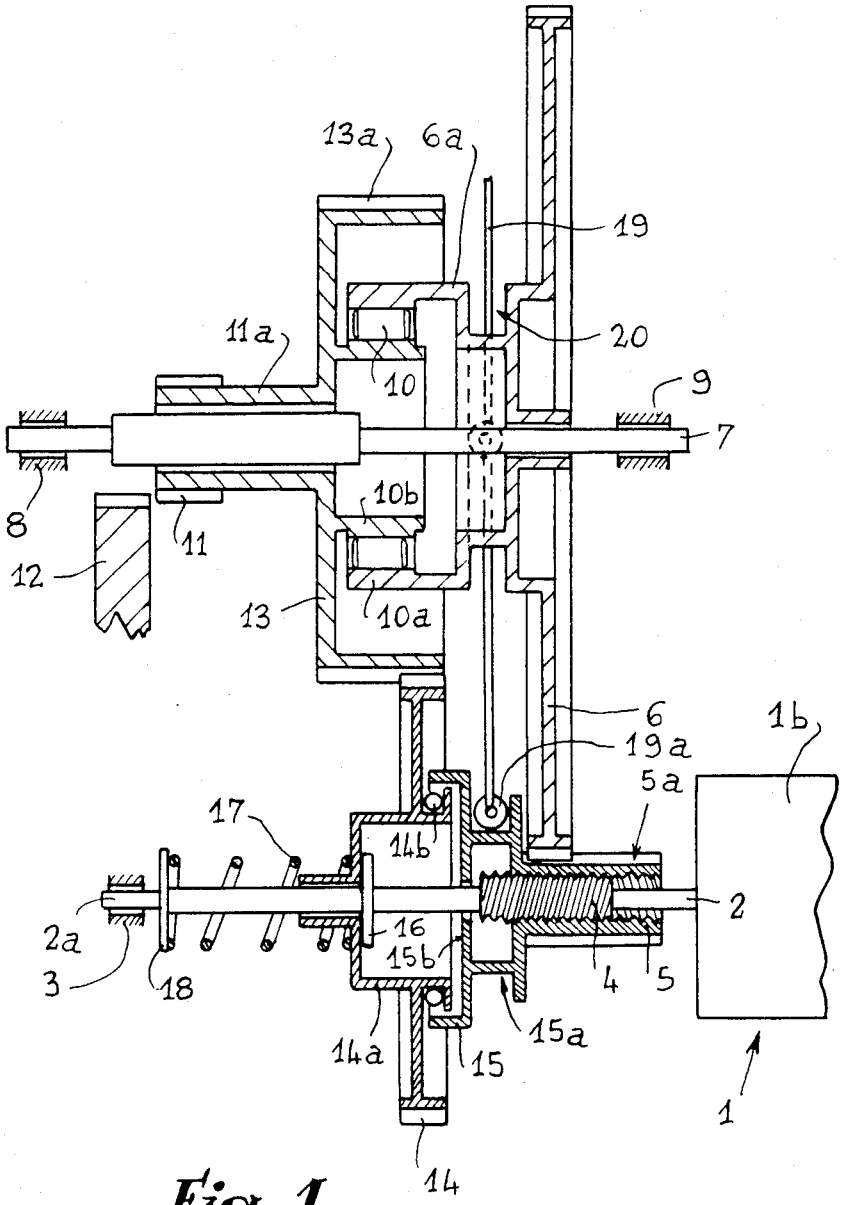
FIG. 1 is a schematic view of a starter according to the invention.

Referring now to the drawings, the starter illustrated in FIG. 1 comprises a pneumatic, hydraulic, electric, etc . . . drive motor 1, of which the shaft 2 presents a free end 2*a* swivelling in a bearing 3. A screw 4 is fixed on shaft 2, its thread cooperating with that of a nut 5 whose periphery comprises teeth 5*a*. The nut 5 meshes by its toothing with that of a gear 6 mounted to rotate freely on a shaft 7 whose ends are fast with bearings 8 and 9. The centre of the gear 6 comprises a cylindrical skirt 6*a* which bears the outer track 10*a* of a unidirectional drive member such as a free wheel 10. The inner track 10*b* of the latter is constituted by a sleeve which follows from the tail 11*a* of the pinion 11 adapted to mesh with the ring gear 12 fast with the crankshaft of the heat engine. The tail 11*a* of the actuator comprises a transverse plate 13 whose periphery is associated with a toothed band 13*a* which lies outside the free wheel 10. The band 13*a* meshes with a toothed ring 14 mounted to rotate with respect to the shaft 2 and whose hub 14*a* bears elements which, under the effect of centrifugal force, are applied against the inner face of a cage 15 fast with the nut 5. In practice, one blocking element is used, constituted by a split ring 14*b* with arched end penetrating in a radial hole made in the hub 14*a*. The latter is applied against a stop 16 fast with the shaft 2 by one end of a compression spring 17 of which the other end rests against a washer 18 likewise fast with the shaft 2. Finally, the presence is noted of a tipping lever 19 of which one of the ends 19*a* bearing a roller is engaged in a groove 15*a* in the cage 15 whilst its other end (not shown) is articulated on a fixed spindle. The lever 19 passes in a depression 20 made between the gear 6 and its skirt 6*a*.

Figure 2:
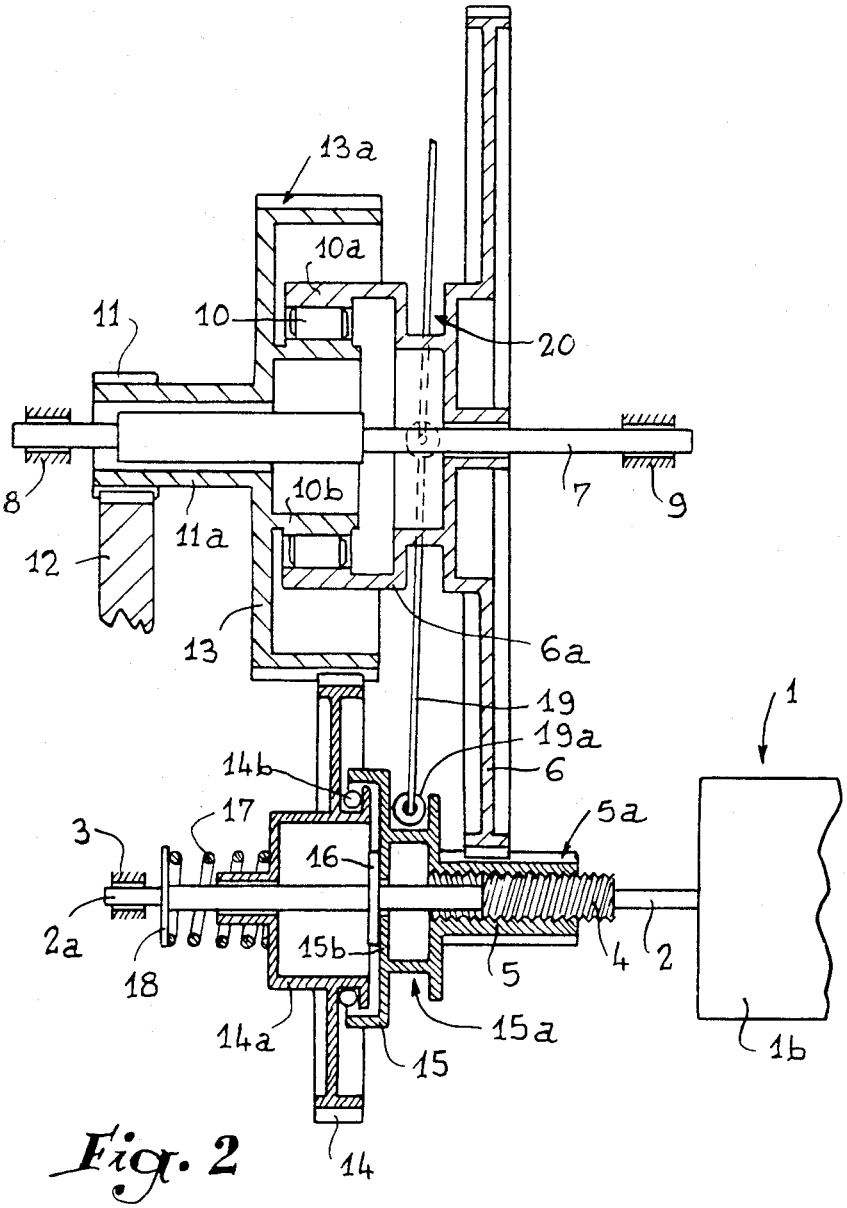
FIG. 2 is a view similar to that of FIG. 1, but illustrating the starter in its position for driving the ring gear of the heat engine.

Operation follows on from the foregoing explanations:

When the motor 1 is started up, the shaft 2 rotates. As the nut 5 is virtually blocked in rotation by the frictions and the inherent inertia of the different elements associated with the shaft 7, the nut 5 is made to advance, with the result that the lever 19 tips, bringing about a displacement of pinion 11 towards the left. As long as this pinion does not encounter any resistance to its translation, the movement continues. On the contrary, if the pinion in question abuts against the outer face of the gear ring 12 without the teeth of these two members being able to interpenetrate, advance of the nut 5 is stopped, with the result that the screw 4 provokes rotation thereof. Rotation of the nut 5 brings about that of gear 6 which, via the free wheel 10, drives pinion 11. As soon as the latter begins its rotation, its teeth come opposite the hollows of the toothing of the ring gear 12 and the initial operational conditions are resumed, i.e. the nut stops rotating and begins its advance to the left again, so that pinion 11 engages perfectly with the ring gear 12, as illustrated in FIG. 2. At the end of translation of the pinion 11, the bottom 15*b* of the cage 15 bears against stop 16 so that advance of nut 5 is stopped. As screw 4 continues to rotate, it rotates said nut which itself provokes rotation of the gear 6 and of pinion 11. In this way, the ring gear 12 rotates in order to start the motor.

When the motor has started up, its high speed of rotation provokes increased rotation of the pinion 11 and the inner track 10*b* of the free wheel 10 which is consequently unblocked, so that the gear 6 is disconnected from pinion 11. Rotation of the latter brings about rotation of the toothed ring 14 so that there is centrifugal throwing into gear to connect said ring and the nut 5. As the speed of rotation of the ring 14 is much greater than its initial speed due to the multiplication provoked by the toothing 13*a*, the nut 5 rotates more quickly than initially, so that it rescrews with respect to screw 4, even if the latter is still driven by motor 1, so that the assembly returns to its initial position of FIG. 1. Of course, supply of motor 1 is then cut off. Furthermore, it may be provided to cut off said supply at the moment of starting of the heat engine to provoke an even more rapid return of the nut 3 to its initial position. It will be observed that the spring 17 which was compressed during the positioning phase of the actuator 11 facilitates return of nut 5.

Figure 3:
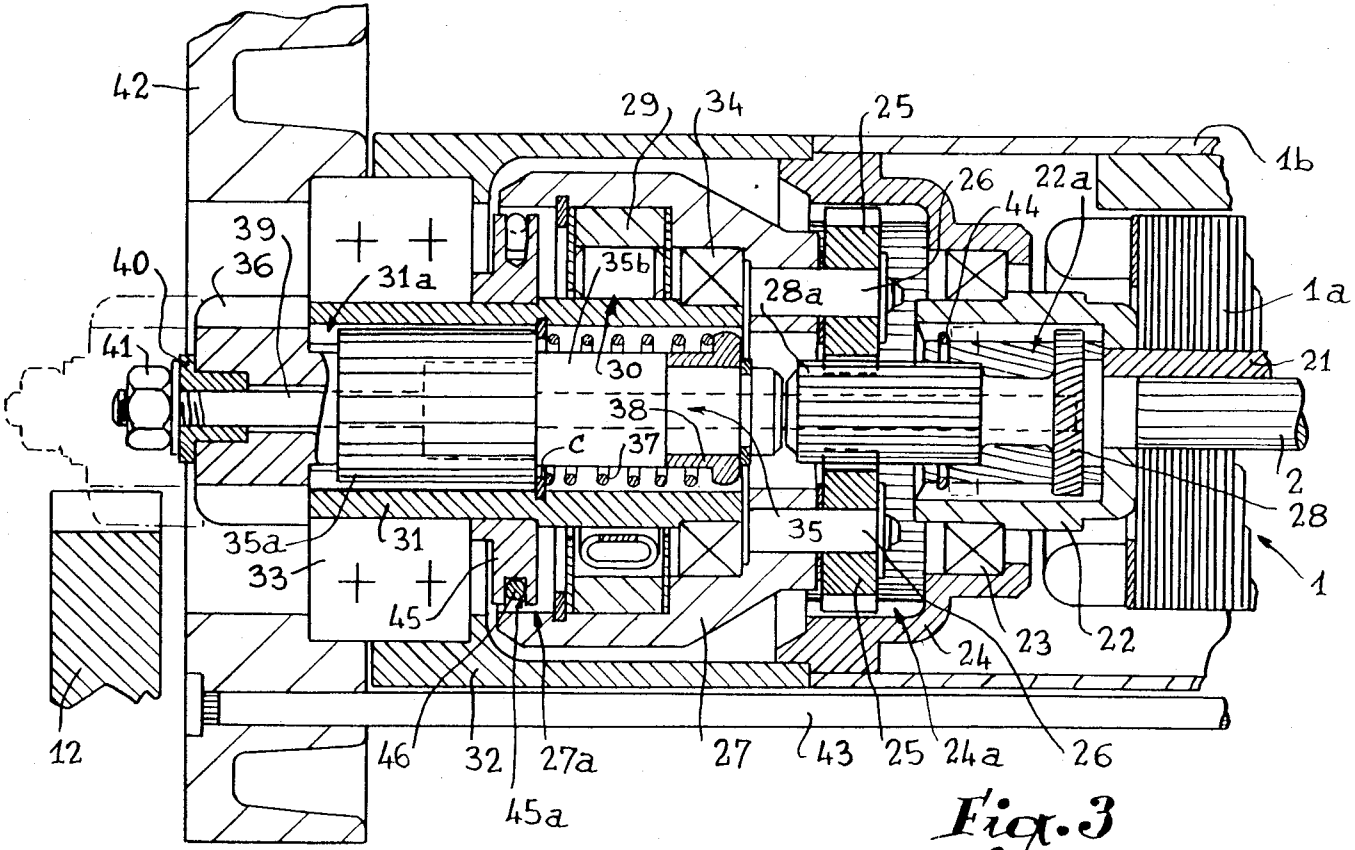
FIG. 3 is a transverse section through a starter according to the invention, but in a preferred variant embodiment.

In a preferred embodiment illustrated in FIG. 3, the starter is driven by an electric motor 1 whose armature 1*a* is fixed on the shaft 2 via a key 21. The end of shaft 2 is associated with a dish-shaped element 22 whose bore is provided with helical grooves 22*a*. The dish 22 is centred by means of a ball bearing 23 with respect to a bearing 24 maintained in position in the casing 1*b* of the motor 1. The bearing 24 comprises an inner toothing 24*a* with which cooperate satellites 25 whose spindles 26 are fast with a bell 27. The pinion 28 which meshes with the grooves 22*a* of the dish 22 is provided with a tail 28*a* whose periphery is toothed. The satellites 25 are in mesh with the toothing of the tail 28*a*.

The bell 27 is rendered fast with a ring constituting the outer track 29 of a free wheel 30 whose inner track is borne by a tubular bush 31. This bush is centred with respect to the casing 32 of the starter which continues from the casing 1*b*, by means of a roller bearing 33 and with respect to bell 27 via a roller bearing 34. The bore of the bush 31 is provided with straight grooves 31*a* with which cooperate complementary grooves 35*a* borne by the tail 35 of the pinion of the actuator 36. A circlips C engaged in a groove in the bore of the bush 31 constitutes a bearing for one of the ends of a compression spring 37 of which the other end is retained by an end piece 38 fast with the tail 35. The pinion 36 and its tail 35 comprise a central bore traversed by a return rod 39 which is screwed in the tail of the pinion 28. The outer end of the return rod 29 comprises a centering stud 40 and a nut 41.

It will be observed that a fixing flange 42 is associated with the casing 32 and the casing 1*b* thanks to tie rods 43 cooperating on the one hand with said flange and on the other hand with the end bearing (not shown) of the casing 1*b*.

Operation follows from the foregoing explanations:

At rest, the starter is in the position illustrated in continuous lines in FIG. 3. When it is desired to actuate the internal combustion engine, the electric motor 1 is supplied so that the armature 1*a* rotates, as well as shaft 2 and dish 22. As in the case of the first embodiment, the frictions and inertia of the different members located downstream of the screw 28 cause the latter to be immobilized in rotation, so that rotation of the dish 22 provokes displacement thereof towards the left. This displacement brings about a translation in the same direction of pinion 36 of the actuator, since the tail of this pinion and that of pinion 28 come into contact with each other. However, there is a functional clearance between these two pieces so that pinion 36 rotates without friction of its tail 35 against that of pinion 28.

In the most frequent hypothesis, the pinion 36 abuts against the outer face of the ring gear 12 as the teeth of these two members lie opposite one another. At that moment, and as for the first example, the advance of the screw 28 being stopped, it resumes rotation with the result that the pinion 36 is automatically oriented and comes into engagement with the teeth of the ring gear 12.

To this end, the toothing of the tail 28*a* of the screw 28 drives the satellite pinions 25 which roll on the toothing 24*a* of the fixed bearing 24, with the result that they drive the bell 27 in rotation. Via the free wheel 30, the latter transmits the movement of rotation to the bush 31 whose inner grooves 31*a* drive pinion 36 in rotation. The toothing of the latter then engages with that of the ring gear, with the result that the rotation of pinion 36 stops until the screw 28 abuts against a circlips 44 engaged in a groove made in the bore of the dish 22. The position of the screw at the end of its translation towards the left has been illustrated in discontinuous lines. Due to its blocking in translation, the screw 28 is driven in rotation, which provokes rotation of pinion 36, so that the motor may start up.

Once the motor is actuated, the ring gear 12 drives the pinion 36 at a speed greater than that which it had when it was driven by the electric motor 1, so that the free wheel 30 stalls. It will be observed that the bush 31 is fast with a ring 45 bearing a peripheral groove 45*a* in which is engaged a split ring 46 immobilized in rotation with respect to ring 45, as explained with reference to FIGS. 1 and 2. As the angular speed of the ring 45 has increased like that of pinion 36, the split ring 46 expands outwardly and bears against the opposite face 27*a* of the bell 27. There is therefore a direct connection of the bush 31 and bell 27 without passing through the free wheel. This rotation thus drives satellites in rotation, which themselves provoke rotation of the screw 28. As the speed of the latter during this phase is much greater than that which it had initially, it returns to its original position illustrated in solid lines in FIG. 3. This return is moreover facilitated by the reaction of spring 37. As in the first embodiment, if the supply of motor 1 has been cut off as soon as the heat engine starts up, the return into initial position of screw 8 is even more rapid.

A starter for heat motor has thus been produced, which responds particularly well to the various desiderata of the art in view of its simplicity and cost price. In addition, thanks to its arrangement allowing adaptation thereof to different types of motor, it suffices to change the actuator pinion 36 by dismantling it by unscrewing the nut 41, and to replace the flange 42. In order to facilitate dismantling, the tail 35 of the pinion 36 might be made in two pieces, i.e. the end 35*b* of this tail would penetrate in its grooved part 35*a* to be centered therein. In this way, dismantling could consist only in withdrawing the pinion 36 and part 35*a* of its tail with respect to the rear part 35*b* thereof, the positioning of another pinion with similar tail presenting no difficulty.

According to a variant embodiment (not shown), the pinion 36 could be engaged on a polygonal end piece of the tail 35. The problems of storage are thus particularly simplified as it suffices to store different flanges and pinions as a function of the heat engine for which the starter is intended, the body of the starter being the same for all applications.

It must be understood that the foregoing description has been given only by way of example and that it in no way limits the domain of the invention which would not be exceeded by replacing the details of execution described by any other equivalents.

What is claimed is:

1. A system for controlling the actuator of a starter incorporating a reduction gear for heat engine, wherein it comprises a screw-nut assembly of which one of the elements is associated with the shaft of the motor for its rotation to provoke advance, against a return spring, of the other element which communicates this movement to the actuator pinion up to a stop blocking its displacement, wherein the movement of the actuator pinion is effected via a driver whose output rotates the pinion of the actuator through a free wheel, said output of the driver being associated with a mechanism comprising a centrifugal clutch, which mechanism provokes relative rotation of the relevant element of the screw-nut assembly with respect to its element associated with the shaft in order to return the assembly in question to its initial position when the pinion of the actuator is driven in rotation by the heat engine.

2. The control system of claim 1, wherein the stop is constituted by the abutment of the actuator pinion against the lateral face of the ring gear of the heat engine.

3. The control system of claim 1, wherein the stop is constituted by a member against which bears that element of the screw-nut assembly which is not fixed on the shaft of the electric motor once the pinion of the actuator is engaged in the toothing of the ring gear.

4. The system of claim 1, wherein the shaft of the electric motor bears a screw cooperating with a nut whose periphery is toothed in order to be in mesh with the input gear of the driver and which constitutes the outer track of the free wheel of which the inner track is fast with the pinion of the actuator, which comprises a toothed wheel in mesh with a toothed ring provided with a centrifugal clutch of which the outer cage is fast with the nut of the screw-nut assembly, whilst said cage is connected by a tipping lever to the driver so that the translations of the nut is transmitted to said driver.

5. The system of claim 4, wherein the driver moves along a fixed shaft which passes right through it.

6. The control system of claim 1, wherein the shaft of the electric motor bears a nut in the form of a dish incorporating helical grooves meshing with a screw whose toothed tail is in mesh with at least one satellite pinion which rotates a bell bearing the outer track of the free wheel, whilst its inner track is constituted by a bush with grooved bore in which slides the tail of complementary shape of the pinion of the actuator, this latter being engaged around a return rod fast with the screw, said bush comprising a centrifugal clutch adapted to connect it to the bell.

7. The control system of claim 6, wherein the satellite or satellites cooperate with a fixed toothed ring, their shafts being fast with the bell.

8. The control system of claim 6, wherein a compression spring is disposed between the tail of the pinion of the actuator and the bush, one of the ens of the spring being associated with the latter whilst the other cooperates with an end piece of said tail.

9. The control system of claim 8, wherein the bore of the dish-shaped nut bears a stop against which the screw abuts when the pinion of the actuator meshes with the ring gear of the heat engine.

10. The control system of claim 6, wherein the centrifugal clutch is constituted by a ring mounted on the bush and whose periphery bears a split ring immobilized in rotation with respect to the ring and which bears against the inside of the bell when the heat engine has started up.

11. The control system of claim 7, wherein it is disposed in a tubular casing provided with a flange for fixation to the heat engine, the ring gear of the driver being assembled by this casing with the casing of the motor.

12. The control system of claim 11, wherein the roller bearing which bears the bush cooperating with the starting pinion ensures both centering of said bush in the casing and centering of the flange.

13. The control system of claim 6, wherein the pinion of the actuator is dismountable with respect to its tail.

* * * * *